US008384288B2

(12) United States Patent
Park et al.

(10) Patent No.: US 8,384,288 B2
(45) Date of Patent: Feb. 26, 2013

(54) ELECTROLUMINESCENT FABRIC EMBEDDING ILLUMINATED FABRIC DISPLAY

(75) Inventors: Sung Mee Park, Atlanta, GA (US); Kwang Su Cho, Yongin-si (KR); Kyung Hee Chung, Seoul (KR)

(73) Assignee: Kolon Glotech, Inc., Gwacheon (KR)

( * ) Notice: Subject to any disclaimer, the term of this patent is extended or adjusted under 35 U.S.C. 154(b) by 0 days.

(21) Appl. No.: 12/747,745

(22) PCT Filed: Dec. 12, 2008

(86) PCT No.: PCT/KR2008/007389

§ 371 (c)(1),
(2), (4) Date: Jun. 11, 2010

(87) PCT Pub. No.: WO2009/075550

PCT Pub. Date: Jun. 18, 2009

(65) Prior Publication Data

US 2010/0277065 A1 Nov. 4, 2010

(30) Foreign Application Priority Data

Dec. 12, 2007 (KR) ..... 10-2007-0128860

(51) Int. Cl.
*H01J 1/70* (2006.01)
*H05B 33/02* (2006.01)

(52) U.S. Cl. ..... 313/609; 313/498; 313/509; 455/46

(58) Field of Classification Search ..... 313/498–512, 313/609

See application file for complete search history.

(56) References Cited

U.S. PATENT DOCUMENTS

| | | | | |
|---|---|---|---|---|
| 3,803,437 | A * | 4/1974 | Robinson | 313/483 |
| 4,851,613 | A * | 7/1989 | Jacques | 174/254 |
| 5,856,029 | A * | 1/1999 | Burrows | 428/690 |
| 6,624,565 | B2 * | 9/2003 | Topelberg | 313/495 |
| 6,697,191 | B2 * | 2/2004 | Kiryuschev et al. | 359/345 |
| 6,835,470 | B1 * | 12/2004 | Magain et al. | 428/690 |
| 2002/0155214 | A1 * | 10/2002 | Murasko et al. | 427/66 |
| 2003/0035917 | A1 * | 2/2003 | Hyman | 428/67 |

FOREIGN PATENT DOCUMENTS

| | | | |
|---|---|---|---|
| JP | 2004-531026 | A | 10/2004 |
| KR | 10-2005-0072703 | A | 7/2005 |
| KR | 10-0571092 | B1 | 4/2006 |
| WO | 02/078035 | A1 | 10/2002 |

* cited by examiner

*Primary Examiner* — Tracie Y Green
(74) *Attorney, Agent, or Firm* — Sughrue Mion, PLLC

(57) ABSTRACT

Disclosed herein is an electroluminescent fabric embedding an illuminated fabric display. The electroluminescent fabric according to the present invention comprises: a foundation layer composed of a synthetic, regenerated or natural fiber; a polymer layer stacked on the base layer; a first bus bar stacked on the polymer layer; a transparent electrode layer stacked on the first bus bar; a fluorescent layer stacked on the transparent electrode layer; a dielectric layer stacked on the fluorescent layer; an interface electrode layer stacked on the dielectric layer; and a second bus bar connected to the interface electrode layer.

10 Claims, 3 Drawing Sheets

ELECTROLUMINESCENT FABRIC EMBEDDING ILLUMINATED FABRIC DISPLAY

TECHNICAL FIELD

The present invention relates to an illuminated fabric display, and more particularly to a fabric implemented in an inorganic EL.

BACKGROUND ART

Generally, illuminated fabric displays (hereinafter, referred simply as to "IFD") are defined as communicating textiles that are well known to display information (character, figure, sign, graph, and so forth) on fabrics as fabric base communicational media for information. Electroluminescent materials, electron element, and sensors are printed on fabrics, so that they radiate light by itself. Data transmitted by light are displayed variously via wireless distant control system. These IFD are distinguished from flexible display or e-paper formed by substituting glass substrates with polymer substrates. It is expected that IFD will be the basis of next generation display.

Until now, fabric-base display technique employs optical fibers inserted into fabrics while weaving, light emitting diode (LED) inserted into conductive textile array, and electroluminescence materials arranged on fabrics.

For instance, luminex developed by luminex company located in Italy means clothes irradiates light by weaving plastic optic fiber. By employing etching techniques, light is emitted. In addition, when optic fibers are weaved, light of LED is emitted conformally via curved portions thereof. Bill-Blanket LightMat manufactured by lumitex company is a fabric using such technique. Meanwhile, plastic optical fibers (POF) as signal transmitting fibers have been introduced, but are not disclosed in various applications. Also, lumalive by Philips develops illuminated materials capable of displaying stop image as well as animation by combining flexible LED device and a control unit on the back of fabrics, but this lumalive can be manufactured by mounting LED on mesh fabrics. Lumimove by Crosslink company is illuminated materials by adopting electroluminescent materials emitting light using electric field and applied in military tents and so forth.

Korea Patent Gazette teaches a flexible inorganic EL comprising: a substrate composed of polymer synthetic rubber, polyurethane, and silicone rubber; a bus bar composed of high-conductivity paste and a binder; a transparent electrode layer composed at least one selected from the group consisting of ITO paste composed of Indium Tin Oxide (ITO) and a binder, Antimony Tin Oxide (ATO), and conductive polymer, or a mixture of conductive polymer and the ITO paste; a fluorescent layer composed of a mixture of fluorescent paste (ZnS) and high-k dielectric constant binder; a dielectric layer composed of a mixture of a dielectric paste and a binder; a conductive layer composed of at least one selected from the group consisting of a mixture of a conductive paste and a binder, conductive organic polymer, and a mixture of conductive paste and organic polymer; and a polymer protecting layer composed of at least one selected from the group consisting of fluoride-based polymer, a binder including polyurethane, and IR or UV curable polymer. A polymer layer having the same material as the polymer protecting layer may be interposed between the substrate and the bus bar. A polymer insulating layer having the same material as the polymer protecting layer may be interposed between the conductive layer and the polymer protecting layer. A second conductive layer having the same material as the conductive layer may be interposed between the conductive layer and the polymer protecting layer.

Additionally, Korea Patent Gazette teaches a two sides light-emitting EL device comprising: a first transparent electrode layer (transparent electrode layer having several nm thickness stacked by sputtering transparent electrode material (e.,g, ITO) disposed on a transparent insulating substrate composed of transparent insulating material (e.,g, PET film); a first EL device comprised of a first fluorescent layer, a first insulating layer, and a back electrode layer (opaque electrode material), which are stacked sequentially; a second EL device disposed on the first EL device and comprised of the back electrode layer used as a common electrode, a second insulating layer, a second fluorescent layer, and a second transparent layer formed by printing technique using paste including transparent electrode material), which are stacked sequentially; and a transparent protecting layer for protecting upper portions and sidewalls of the first and second EL devices, wherein the transparent electrode layer is formed by a printing technique using ink made of polyester material or film to be laminated. The first and second transparent electrode layers are connected to a first output terminal in parallel of a driving circuit. The back electrode layer is connected to a second output terminal. The first electrode layer, the back electrode layer, and the second transparent layer are connected to the first output terminal, the second output terminal, and a third output terminal of the driving circuit, respectively.

While EL devices of the above-mentioned patents may be feasible when applied to PET films, polymer synthetic rubbers, polyurethane, or silicone rubbers, they may present additional difficulties and inherent limitations of their application on fabrics.

There are the limitations that it is difficult for a illuminated fabric display to be capable of achieving high luminance with respect to single or multi color information such as character, figure, sign, graph, and so forth as well as having excellent flex resistance, wash resistance, wear resistance, durability, flexibility, drape, electrical stability, 3D function.

Moreover, a conventional illuminated fabric display employing a substrate composed of optical fiber, polymer synthetic rubber, polyurethane, or silicone rubber has characteristics of low elasticity and softness. Even if it has elasticity and softness, it is not enough to be applied in industry due to the limited use thereof.

DISCLOSURE

Technical Problem

The present invention has been made in an effort to solve the above problems, and it is an object of the present invention to provide an illuminated fabric display is capable of achieving high luminance with respect to single or multi color information such as character, figure, sign, graph, and so forth as well as having excellent flex resistance, wash resistance, wear resistance, durability, flexibility, drape, electrical stability, 3D function.

Technical Solution

Embodiments of the present invention provide an electroluminescent fabric embedding an illuminated fabric display comprising: a foundation layer composed of a synthetic, regenerated or natural fiber; a polymer layer stacked on the base layer; a first bus bar stacked on the polymer layer; a transparent electrode layer stacked on the first bus bar; a fluorescent layer stacked on the transparent electrode layer; a dielectric layer stacked on the fluorescent layer; an interface electrode layer stacked on the dielectric layer; and a second bus bar stacked on the interface electrode layer.

In some embodiments of the present invention, the polymer layer is at least one selected from the group consisting of fluoride-based polymer, a binder including polyurethane, and IR or UV curable polymer.

In other embodiments of the present invention, the transparent electrode layer is composed of at least one selected from the group consisting of ITO paste, ATO (antimony tin oxide), conductive polymer, and a mixture of conductive polymer and ITO powder.

In further embodiments of the present invention, the first and second bus bars are a mixture of silver, gold, or copper powder and a binder.

In other embodiments of the present invention, electroluminescent fabric embedding an illuminated fabric display comprising: a conductive fabric composed of a conductive layer, wherein the conductive layer comprises: a) a base layer composed of a synthetic, regenerated or natural fiber; b) a primer layer composed of at least one selected from the group consisting of a water-dispersible polyurethane resin, a solvent-type polyurethane resin, an oil-soluble acrylic resin, a water-soluble acrylic resin and a silicone resin; and c) a conductive layer being a mixture of a conductive material being at least one selected from the group consisting of a conductive polymer, carbon, a metal material such as silver and a binder being at least one selected from the group consisting of a water-dispersible polyurethane resin, a solvent-type polyurethane resin, an oil-soluble acrylic resin, a water-soluble acrylic resin and a silicone resin; a fluorescent layer stacked on the conductive fabric; a dielectric layer stacked on the fluorescent layer; an interface electrode layer stacked on the dielectric layer; and a second bus bar stacked on the interface electrode layer.

In yet other embodiments of the present invention, the primer layer is formed in a multilayer structure with a water-repellent layer.

In further embodiments of the present invention, the conductive polymer is at least one selected from the group consisting of polyaniline, polypyrrole, polythiophene, polysulfurnitride, and polystyrenesulfonate.

In other embodiments of the present invention, the conductive material and the binder are mixed in a weight ratio of 90:10 to 80:20 to form the conductive layer. In further embodiments of the present invention, the conductive layer has a thickness of 2 mm to 500 mm.

In yet further embodiments of the present invention, wherein the conductive layer has a width of 10 mm to 20 mm.

In other embodiments of the present invention, the conductive fabric has a resistance difference before and after washing of 0.5Ω to 4 Ω.

In yet other embodiments of the present invention, the second bus bar is a mixture of silver, gold, or copper powder and a binder.

In further embodiments of the present invention, the conductive fabric is made by the method comprising: forming a primer layer on the base layer to maintain the thickness of the conductive layer at a constant level; and forming a conductive layer on the primer layer.

In other embodiments of the present invention, calendering the base layer using a pressing roller before the formation of the conductive layer to make the surface of the base layer smooth, offset pores of the base layer and enhance the flex resistance of the conductive fabric is further included.

In further embodiments of the present invention, the insulating layer formed by coating, printing, laminating, or bonding at least one selected from the group consisting of polyurethane, acrylic, silicone, polyester, polyvinyl chloride (PVC) and polytetrafluoroethylene (PTFE)-based resins is further stacked on the second bus bar.

In yet further embodiments of the present invention, breathable waterproofing/waterproofing the base layer after the calendering to offset pores of the electroluminescent fabric and enhance the insulating properties, wash resistance and flex resistance of the conductive fabric is further included.

In other embodiments of the present invention, the insulating layer is formed by dry coating, hot-melt dot lamination or gravure lamination.

In yet other embodiments of the present invention, the fluorescent layer is a mixture of at least one selected from the group consisting of ZnS:(Ag, Li), ZnS:Cu, Al), and $Y_2O_2S$:Eu and a binder.

In further embodiments of the present invention, the dielectric layer is a mixture of high dielectric constant material (including $BaTiO_3$) and a binder (including cyanoethyl pullulan or fluoro resin).

In other embodiments of the present invention, the interface electrode layer is composed of at least one selected from the group consisting of: a) a mixture of a conductive powder and a binder; b) conductive organic polymer; and a mixture of conductive powder and conductive organic polymer.

In further embodiments of the present invention, brightness ranges from 50 to 70 cd/cm$^2$ in accordance with KS C7163, and a pixel number ranges from 16×16 to 32×32, and wash resistance ranges from 20 to 60 times in accordance with KS K ISO 6330, and flex resistance ranges from 100 to 250 times in accordance with KS K 0855.

Advantageous Effects

According to the present invention, the illuminated fabric display is capable of achieving high luminance with respect to single or multi color information such as character, figure, sign, graph, and so forth as well as having excellent flex resistance, wash resistance, wear resistance, durability, flexibility, drape, electrical stability, 3D function. In addition, the illuminate fabric display according to the present invention is advantageous because it has fast response speed, high luminance, low electric power, and ultra-thinning. Accordingly, it can be widely used in the field of textile displays.

Further, the electroluminescent fabric embedding the illuminated fabric display has excellent elasticity and softness, so that it is very feasible in various industries.

BRIEF EXPLANATION OF ESSENTIAL PARTS OF THE DRAWINGS

Figure 1:
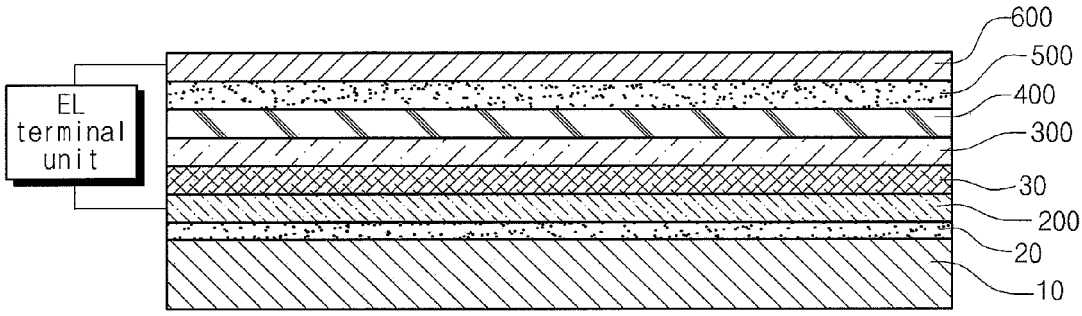
FIG. 1 is a construction diagram showing an electroluminescent fabric embedding an illuminated fabric display according to an embodiment of the present invention.

| | |
|---|---|
| 10: Foundation layer, | 20: Polymer layer, |
| 30: Transparent electrode layer, | 100: Conductive fabric, |
| 102: Base layer, | 104: Printing layer, |
| 106: Conductive layer, | 200: First bus bar |
| 300: Fluorescent layer, | 400: Dielectric layer |
| 500: Interface electrode layer, | 600: Second bus bar |
| 700: Insulating layer | |

BEST MODE

Preferred embodiments of the present invention will now be described in detail with reference to the accompanying drawings. It should be noted that whenever possible, the same reference numerals will be used throughout the drawings and the description to refer to the same or like parts. In describing the present invention, detailed descriptions of related known functions or configurations are omitted in order to avoid making the essential subject of the invention unclear.

As used herein, the terms "about", "substantially", etc. are intended to allow some leeway in mathematical exactness to account for tolerances that are acceptable in the trade and to prevent any unconscientious violator from unduly taking advantage of the disclosure in which exact or absolute numerical values are given so as to help understand the invention.

As utilized herein, the term "fabric" is intended to include articles produced by weaving or knitting, non-woven fabrics, fiber webs, and so forth.

Figure 2:
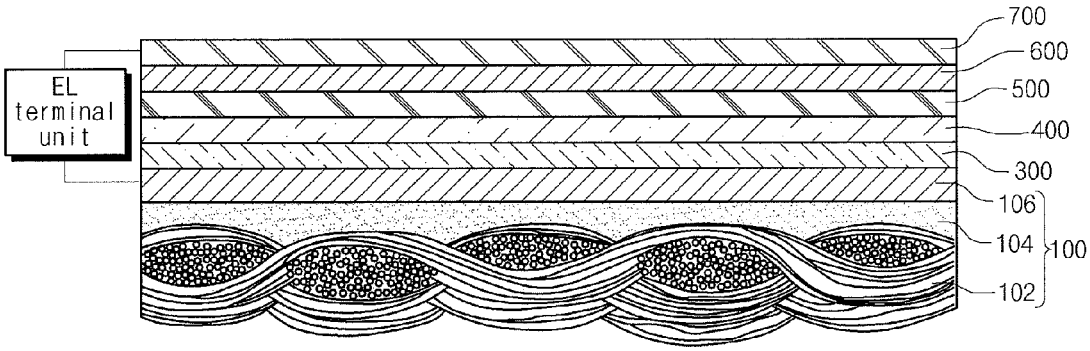
FIG. 2 is a construction diagram showing an electroluminescent fabric embedding an illuminated fabric display according to another embodiment of the present invention.
Figure 5:
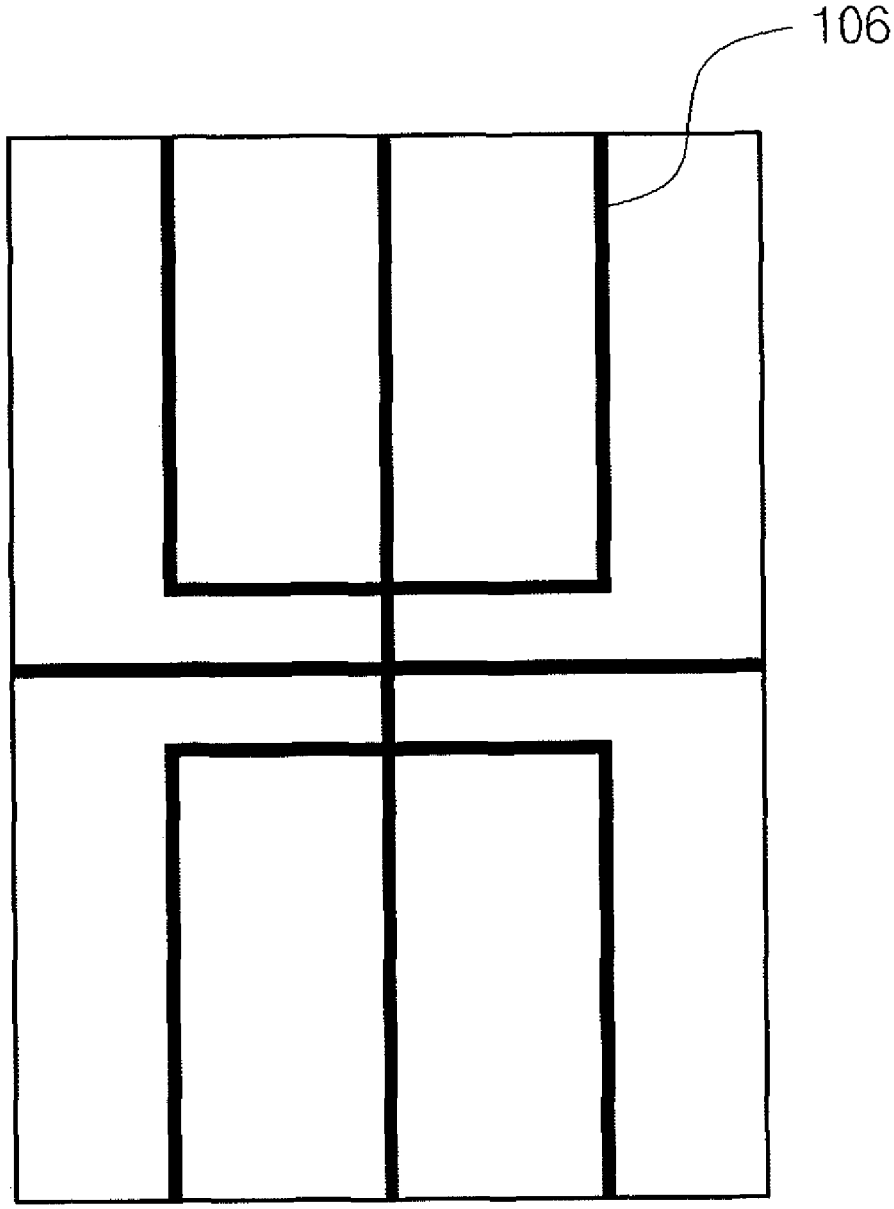
FIG. 5 is an exemplary construction showing a pattern of a conductive layer of a conductive fabric according to another embodiment of the present invention.

FIG. 1 is a construction diagram showing an electroluminescent fabric embedding an illuminated fabric display according to an embodiment of the present invention. FIG. 2 is a construction diagram showing an electroluminescent fabric embedding an illuminated fabric display according to another embodiment of the present invention. FIG. 5 is an exemplary construction showing a pattern of a conductive layer of a conductive fabric according to another embodiment of the present invention.

Referring to FIG. 1, an electroluminescent fabric display embedding an illuminated fabric display according to an embodiment of the present invention comprises a foundation layer 10 composed of a synthetic, regenerated or natural fiber, a polymer layer 20 stacked on the base layer 10, a first bus bar 200 stacked on the polymer layer, a transparent electrode layer 30 stacked on the first bus bar 200, a fluorescent layer 300 stacked on the transparent electrode layer 30, a dielectric layer 400 stacked on the fluorescent layer 300, an interface electrode layer 500 stacked on the dielectric layer 400, and a second bus bar 600 stacked on the interface electrode layer 500.

Preferably, the polymer layer 20 stacked on the foundation layer 10 performs a function to improve adhesion between the first bus bar 300 and the foundation layer 10. The polymer layer 20 is made of fluoride-based polymer, a binder including polyurethane, and IR or UV curable polymer. It is preferable that the polymer layer 20 has a thickness of 1 mm to 60 mm.

The first bus bar 200 stacked on the polymer layer 20 and the second bus bar 600 stacked on the interface layer 500 are a mixture of silver, gold, or copper powder and a binder. It is preferable that they have a thickness of 1 mm to 20 mm. The first and second bus bars 200 and 600 that are pattered additionally perform functions to complement uniformity lowering phenomenon due to low conductivity as well as remove noise. It is preferable that the first and second bus bars are connected to an EL terminal unit.

The transparent electrode layer 30 stacked on the first bus bar 200 is composed of ITO paste composed of ITO powder and a binder, ATO (antimony tin oxide), conductive polymer, and a mixture of conductive polymer and ITO powder. In this regard, the conductive polymer is at least one selected from the group consisting of polyaniline, polypyrrole, polythiophene, polysulfurnitride, polystyrenesulfonate, or a mixture of conductive polymer and ITO powder. It is preferable that the transparent electrode layer 30 has a thickness of 0.1 mm to 10 mm.

The fluorescent layer 300 stacked on the transparent electrode layer 30 is a mixture of at least one selected from the group consisting of ZnS:(Ag, Li), ZnS:(Cu, Al), and $Y_2O_2S$:Eu and a binder. It is preferable that the fluorescent layer 300 has a thickness of 1 mm to 50 mm. A binder used in the fluorescent layer 300 preferably has dielectric constant higher than that of fluorescent powder. Common examples are cyanoethyl pullulan, fluoro resin, and so forth.

Preferably, the dielectric layer 400 is a mixture of high-k dielectric material such as $BaTiO_3$ and a binder, for example, cyanoethyl pullulan or fluoro resin. It is preferable that the dielectric layer 400 has a thickness of 1 mm to 30 mm.

The interface electrode layer 500 is a mixture (paste type) of a conductive powder such as carbon, silver or copper powder, or copper powder coated with silver and a binder, conductive polymer such as polyaniline, polypyrrole, polythiophene, polysulfurnitride, and polystyrenesulfonate, and a mixture of a conductive powder and conductive organic polymer. It is preferable that the interface layer 500 has a thickness of 1 mm to 30 mm.

The construction of the present invention can be simplified using conductive fabrics. An electroluminescent fabric display using conductive fabrics according to another embodiment comprises a conductive fabric 100 composed of a conductive layer, wherein the conductive layer comprises a) a base layer 102 composed of a synthetic, regenerated or natural fiber, b) a primer layer 104 composed of at least one selected from the group consisting of a water-dispersible polyurethane resin, a solvent-type polyurethane resin, an oil-soluble acrylic resin, a water-soluble acrylic resin and a silicone resin, and c) a conductive layer 106 being a mixture of a conductive material being at least one selected from the group consisting of a conductive polymer, carbon, a metal material such as silver and a binder being at least one selected from the group consisting of a water-dispersible polyurethane resin, a solvent-type polyurethane resin, an oil-soluble acrylic resin, a water-soluble acrylic resin and a silicone resin, a fluorescent layer 300 stacked on the conductive fabric, a dielectric layer 400 stacked on the fluorescent layer 300, an interface electrode 500 layer stacked on the dielectric layer 400, and a second bus bar 600 stacked on the interface electrode layer 500.

Figure 3:
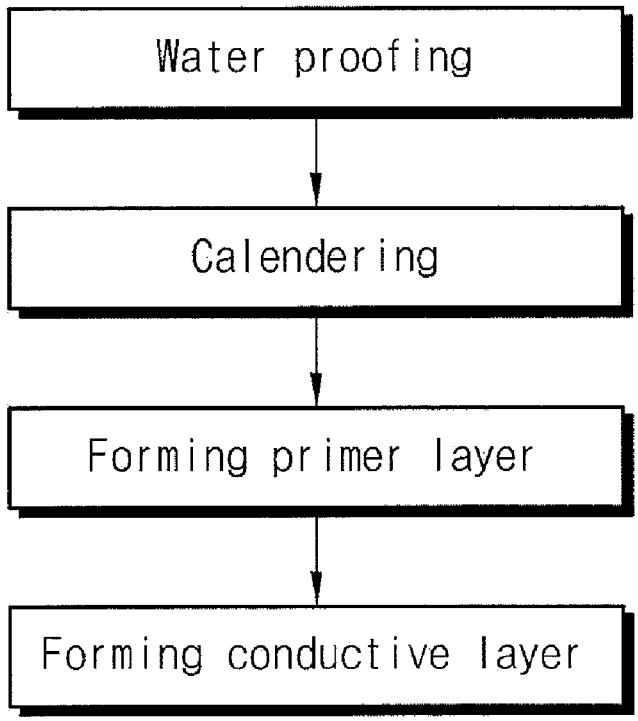
FIGS. 3 and 4 are process flowcharts for illustrating a conductive fabric of an electroluminescent fabric according to another embodiment of the present invention.
Figure 4:
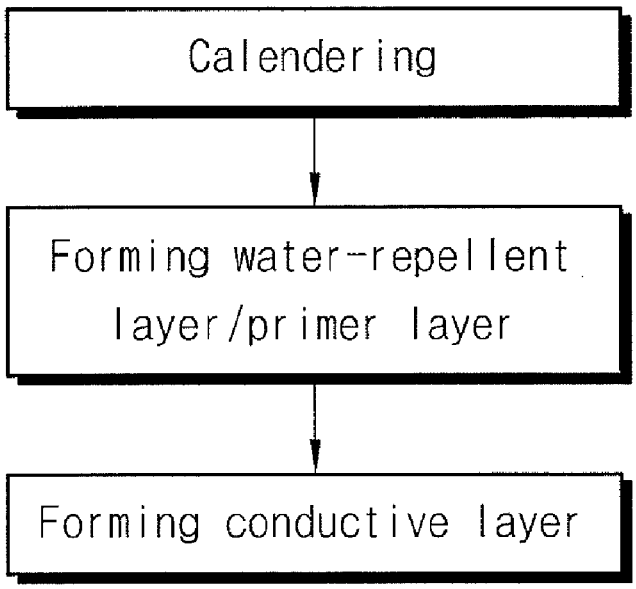

FIGS. 3 and 4 are process flowcharts for illustrating a conductive fabric of an electroluminescent fabric according to another embodiment of the present invention.

As shown in FIGS. 3 and 4, the conductive fabric 100 comprises: forming a primer layer on the base layer composed of a synthetic, regenerated or natural fiber to maintain the thickness of the conductive layer at a constant level, forming a conductive layer to be electrically flowed on the primer layer, and forming an insulating layer on the conductive layer for preventing damages of conductive layer.

Calendering the base layer 102 using a pressing roller to make the surface of the base layer 102 smooth, offset pores of the base layer 102 and enhance the flex resistance of the conductive fabric 100 may be further included.

By calendering the base layer 102 of the conductive fabric 100, the surface of the base layer 102 smoothed, and the pores of the base layer 102 are offset. Resultantly, the flex resistance of fabrics can be enhanced as a whole.

Meanwhile, breathable waterproofing/waterproofing with respect to the conductive fabric 100 constituted with the base layer 102 can be processed selectively after the calendering. Breathable waterproofing/waterproofing the base layer performs a function to offset pores of fabrics constituted with the base layer 102 and complement the insulating properties, wash resistance and flex resistance of thereof. Materials used in breathable waterproofing are preferably resins, which are compatible with conductive materials.

The primer layer 104 may be formed by knife rolling, over roll coating, floating knife coating, knife over roll coating a solvent-type polyurethane resin, a water-dispersible polyurethane resin, an oil-soluble acrylic resin, a water-soluble acrylic resin, and a silicone resin.

Also, the primer layer 104 may be formed in a single layer or multi-layered layer together with a water-repellent layer (not shown). The water-repellent layer can be formed by a common water-repellent processing method. Non-limiting examples of suitable materials for the water-repellent layer include fluorine and silicone. The water-repellent layer may be formed on or under the fabric of the conductive layer 106 to prevent the resin constituting the conductive layer from permeating into the base layer 102.

As afore-mentioned, in the event that the primer layer 104 is formed in a multi-layered structure with the water-repellent layer, this water-repellent layer may be formed before/after calendering. FIG. 3 is an example of forming a water-repellent layer before calendering. FIG. 4 is an example of forming a water-repellent layer and/or the primer layer 104 after calendering. The present invention is not limited to these exemplary embodiments.

The conductive layer 106 is formed according to a pre-designed pattern on the primer layer 104.

The conductive layer 106 is stacked by mixing conductive materials selected from the group consisting of conductive polymer, carbon, and metal (including silver) and a binder. It is preferable that the weight ratio of the conductive material and the binder is 90:10 to 80:20.

The conductive polymer is at least one selected from the group consisting of polyaniline, polypyrrole, polythiophene, polysulfurnitride, and polystyrenesulfonate. The binder may be at least one selected from the group consisting of a solvent-type polyurethane resin, a water-dispersible polyurethane resin, an oil-soluble acrylic resin, a water-soluble acrylic resin, and a silicone resin.

Preferably, the conductive layer 106 has a thickness of 2 mm to 500 mm. When the thickness of the conductive layer 106 is below the above-mentioned range, it is difficult to ensure the thickness uniformity of the conductive layer 106. Meanwhile, when the thickness of the conductive layer 400 is above the range, resistance becomes decreased, thereby leading to an increment in power consumption.

The conductive layer 106 preferably has a width of 10 mm to 20 mm. Although an increment in the width of the conductive layer 106 leads to a reduction in resistance and a stable flow of electricity, an excessive increment under the same voltage in the width of the conductive layer 106 without limitation causes the problems of increased production costs and poor coatability. It is preferable that the fabric of the present invention has a resistance difference of 0.5Ω to 4Ω before and after washing. It is actually difficult to attain the resistance difference below this range, and the resistance difference above this range impedes the stable flow of electricity.

The conductive layer 106 can be formed by various techniques, such as coating, printing and transfer printing. When the conductive layer 106 is formed by printing, a circuit can be designed in fabrics according to the pre-designed pattern, regardless of the placement of electronic devices.

FIG. 5 is an example of a conductive patter forming the conductive layer 106 on conductive fabrics. Various circuit patterns can be embodied without the conductive patter shown in FIG. 5. In view of the foregoing, the conductive fabric of the present invention can be termed a 'flexible printed fabric circuit board (FPFCB)'.

The conductive fabric 100 and the second bus bar 600 of the electroluminescent fabric embedding the illuminated fabric display according to the present invention is connected to the EL terminal unit.

In order to improve flexibility, breathable waterproofing, and waterproofing of the electroluminescent fabric embedding the illuminated fabric display, an insulating layer 700 may be formed on the second bus bar 600.

The insulating layer 700 may be formed by direct coating, printing or laminating a solvent-type polyurethane resin, a water-dispersible polyurethane resin, an oil-soluble acrylic resin, a water-soluble acrylic resin, a silicone resin, a polyester resin or a polytetrafluoroethylene (PTFE) resin on the conductive layer 300. Dry coating, hot-melt dot lamination or gravure lamination is preferably employed to form the insulating layer. The insulating layer 700 is formed by drying in case of direct coating, or hot-melt dot or gravure printing in case of laminating.

The insulating layer 700 can be formed on one or both surfaces of the electroluminescent fabric. Taking into consideration the fact that the electroluminescent fabric undergoes washing several times, it is preferable that the insulating layer 106 is employed for long-term insulation.

The electroluminescent fabric according to the present invention, brightness ranges from 50 to 70 cd/cm$^2$ in accordance with KS C7163, and a pixel number ranges from 16—16 to 32×32, and wash resistance ranges from 20 to 60 times in accordance with KS K ISO 6330, and flex resistance ranges from 100 to 250 times in accordance with KS K 0855.

MODE FOR INVENTION

Examples

Example 1

In an electroluminescent fabric embedding an illuminated fabric display comprising a foundation layer 10 composed of a synthetic, regenerated or natural fiber, a polymer layer 20 stacked on the base layer 10, a first bus bar 200 stacked on the polymer layer, a transparent electrode layer 30 stacked on the first bus bar 200, a fluorescent layer 300 stacked on the transparent electrode layer 30, a dielectric layer 400 stacked on the fluorescent layer 300, an interface electrode layer 500 stacked on the dielectric layer 400, and a second bus bar 600 stacked on the interface electrode layer 500, its brightness was 55 cd/cm$^2$ in accordance with KS C7163, wash resistance was 33 times in accordance with KS K ISO 6330, and flex resistance was 140 times in accordance with KS K 0855.

Example 2

In an electroluminescent fabric embedding an illuminated fabric display comprising a foundation layer 10 composed of a synthetic, regenerated or natural fiber, a polymer layer 20 stacked on the base layer 10, a first bus bar 200 stacked on the polymer layer, a transparent electrode layer 30 stacked on the first bus bar 200, a fluorescent layer 300 stacked on the transparent electrode layer 30, a dielectric layer 400 stacked on the fluorescent layer 300, an interface electrode layer 500 stacked on the dielectric layer 400, a second bus bar 600 stacked on the interface electrode layer 500, and an insulating layer formed by coating, printing, laminating, or bonding at least one selected from the group consisting of polyurethane, acrylic, silicone, polyester, polyvinyl chloride (PVC) and polytetrafluoroethylene (PTFE)-based resins is further stacked on the second bus bar, its brightness was 57 cd/cm$^2$ in accordance with KS C7163, wash resistance was 41 times in accordance with KS K ISO 6330, and flex resistance was 154 times in accordance with KS K 0855.

Example 3

In an electroluminescent fabric display using conductive fabrics according to another embodiment comprises a conductive fabric 100 composed of a conductive layer, wherein the conductive layer comprises a) a base layer 102 composed of a synthetic, regenerated or natural fiber, b) a primer layer 104 composed of at least one selected from the group consisting of a water-dispersible polyurethane resin, a solvent-type polyurethane resin, an oil-soluble acrylic resin, a water-soluble acrylic resin and a silicone resin, and c) a conductive layer 106 being a mixture of a conductive material being at least one selected from the group consisting of a conductive polymer, carbon, a metal material such as silver and a binder being at least one selected from the group consisting of a water-dispersible polyurethane resin, a solvent-type polyurethane resin, an oil-soluble acrylic resin, a water-soluble acrylic resin and a silicone resin, a fluorescent layer 300 stacked on the conductive fabric, a dielectric layer 400 stacked on the fluorescent layer 300, an interface electrode 500 layer stacked on the dielectric layer 400, and a second bus bar 600 stacked on the interface electrode layer 500, its brightness was 67 cd/cm$^2$ in accordance with KS C7163, wash resistance was 46 times in accordance with KS K ISO 6330, and flex resistance was 170 times in accordance with KS K 0855.

Example 4

In an electroluminescent fabric display using conductive fabrics according to another embodiment comprises a conductive fabric 100 composed of a conductive layer, wherein the conductive layer comprises a) a base layer 102 composed of a synthetic, regenerated or natural fiber, b) a primer layer 104 composed of at least one selected from the group consisting of a water-dispersible polyurethane resin, a solvent-type polyurethane resin, an oil-soluble acrylic resin, a water-soluble acrylic resin and a silicone resin, and c) a conductive layer 106 being a mixture of a conductive material being at least one selected from the group consisting of a conductive polymer, carbon, a metal material such as silver and a binder being at least one selected from the group consisting of a water-dispersible polyurethane resin, a solvent-type polyurethane resin, an oil-soluble acrylic resin, a water-soluble acrylic resin and a silicone resin, a fluorescent layer 300 stacked on the conductive fabric, a dielectric layer 400 stacked on the fluorescent layer 300, an interface electrode 500 layer stacked on the dielectric layer 400, and a second bus bar 600 stacked on the interface electrode layer 500, and an insulating layer formed by coating, printing, laminating, or bonding at least one selected from the group consisting of polyurethane, acrylic, silicone, polyester, polyvinyl chloride (PVC) and polytetrafluoroethylene (PTFE)-based resins is further stacked on the second bus bar, its brightness was 69 cd/cm$^2$ in accordance with KS C7163, wash resistance was 57 times in accordance with KS K ISO 6330, and flex resistance was 231 times in accordance with KS K 0855.

According to illuminated fabric display techniques, personalities of users can be expressed by transforming color, characteristic, graphic, and so forth. By displaying electronic-books, electronic watches, maps on clothes, brand new and unique functions can be performed, and various applications can be possible in fields of military uniforms, military tents, safety clothes, clothes for preventing missing children, etc. In addition, these techniques can be used variously in applications for advertising and interior. For instance, various interior decorations effect can be produced by changing images of ornaments such as curtains, sofas, and so forth, and frames for displaying where images are changed in real time can be manufactured.

Although the present invention has been described herein with reference to the foregoing embodiments and the accompanying drawings, the scope of the present invention is defined by the claims that follow. Accordingly, those skilled in the art will appreciate that various substitutions, modifications and changes are possible, without departing from the spirit of the present invention as disclosed in the accompanying claims. It is to be understood that such substitutions, modifications and changes are within the scope of the present invention.

Particularly, although the electronic fabric according to the present invention only has been described in the field of keyboard apparatus among smart clothes throughout the specification, it will of course appreciated that the present invention is not limited thereto and can be applicable to flexible displays, touch panels, and so forth as well as to circuit substrates or parts of electronic devices in itself.

The invention claimed is:

1. An electroluminescent fabric embedding an illuminated fabric display comprising:

(1) a conductive fabric composed of:

a) a base layer composed of a synthetic, regenerated or natural fiber;

b) a primer layer composed of at least one selected from the group consisting of a water-dispersible polyurethane resin, a solvent-type polyurethane resin, an oil-soluble acrylic resin, a water-soluble acrylic resin and a silicone resin; and c) a patterned conductive layer being a mixture of a conductive material being at least one selected from the group consisting of a conductive polymer, carbon, a metal material and a binder being at least one selected from the group consisting of a water-dispersible polyurethane resin, a solvent-type polyurethane resin, an oil-soluble acrylic resin, a water-soluble acrylic resin and a silicone resin;

(2) a fluorescent layer stacked on and in contact with the conductive fabric;

(3) a dielectric layer stacked on and in contact with the fluorescent layer;

(4) an interface electrode layer stacked on and in contact with the dielectric layer; and (5) a patterned bus bar stacked on the interface electrode layer, (6) an insulating layer is stacked on the bus bar, wherein the primer layer is formed on the base layer to maintain the thickness of the conductive layer at a constant level; and wherein the insulating layer is formed by at least one of coating, printing, laminating, or bonding at least one selected from the group consisting of polyurethane, acrylic, silicone, polyester, polyvinyl chloride (PVC) and polytetrafluoroethylene (PTFE)-based resins.

2. The electroluminescent fabric according to claim 1, wherein the primer layer is formed in a multilayer structure with a water-repellent layer.

3. The electroluminescent fabric according to claim 1, wherein the conductive polymer is at least one selected from the group consisting of polyaniline, polypyrrole, polythiophene, polysulfurnitride, and polystyrenesulfonate.

4. The electroluminescent fabric according to claim 1, wherein the conductive material and the binder are mixed in a weight ratio of 90:10 to 80:20 to form the conductive layer.

5. The electroluminescent fabric according to claim 1, the conductive layer has a thickness of 2 mm to 500 mm.

6. The electroluminescent fabric according to claim 1, wherein the conductive layer has a width of 10 mm to 20 mm.

7. The electroluminescent fabric according to claim 1, wherein the conductive fabric has a resistance difference before and after washing of 0.5Ω to 4 Ω.

8. The electroluminescent fabric according to claim 1, wherein the bus bar is a mixture of silver, gold, or copper powder and a binder.

9. The electroluminescent fabric according to claim 1, wherein the base layer is calendared, said calendaring using a pressing roller before the formation of the conductive layer makes the surface of the base layer smooth, offset pores of the base layer and enhance the flex resistance of the conductive fabric.

10. The electroluminescent fabric according to claim 1, further comprising breathable waterproofing/waterproofing the base layer after the calendering to offset pores of the electroluminescent fabric and enhance the insulating properties, wash resistance and flex resistance of the conductive fabric.

* * * * *